US005344345A

United States Patent [19]

Nagata

[11] Patent Number: 5,344,345

[45] Date of Patent: Sep. 6, 1994

[54] WATER VESSEL PROPULSION APPARATUS

[75] Inventor: Fumio Nagata, Toyonaka, Japan

[73] Assignee: IDC Corporation, Osaka, Japan

[21] Appl. No.: 70,788

[22] Filed: Jun. 3, 1993

[30] Foreign Application Priority Data

Jun. 3, 1992 [JP] Japan ..... 4-187295

[51] Int. Cl.[5] ..... B63H 11/00

[52] U.S. Cl. ..... 440/44; 440/47

[58] Field of Search ..... 440/38, 40, 41, 42, 440/43, 44, 47; 114/274; 60/221, 222; 239/265.27, 265.35

[56] References Cited

U.S. PATENT DOCUMENTS

| | | | |
|---|---|---|---|
| 3,149,600 | 9/1964 | Traksel | 440/42 |
| 3,273,333 | 9/1966 | Roulund | 440/44 |
| 3,288,100 | 11/1966 | Cox et al. | 440/44 |
| 3,875,885 | 4/1975 | Balquet et al. | 440/44 |
| 4,767,364 | 8/1988 | Lenz | 440/44 |
| 5,049,096 | 9/1991 | Henn | 440/42 |

FOREIGN PATENT DOCUMENTS

| | | |
|---|---|---|
| 52-18695 | 12/1977 | Japan . |
| 53-87487 | 8/1978 | Japan . |
| 57-110595 | 7/1982 | Japan . |

*Primary Examiner*—Stephen P. Avila

*Attorney, Agent, or Firm*—Wenderoth, Lind & Ponack

[57] ABSTRACT

A water jet propulsion apparatus creates a high speed water jet rearwardly through a duct in a hull by injecting air and water into the duct from at least one injection port, thereby to impart a thrust to the hull. The need of forming protrusions such as an impeller within the duct thus is eliminated, and the resistance loss of the jet is minimized. Propulsion efficiency is improved remarkably and noise is reduced, while at the same time course stability is improved.

26 Claims, 9 Drawing Sheets

WATER VESSEL PROPULSION APPARATUS

BACKGROUND OF THE INVENTION

1. Field of the Invention

The present invention relates to a water vessel propulsion apparatus for production thrust by means of a water jet or jets.

2. Description of the Related Art

Conventional water jet propulsion apparatuses shown in FIGS. 1 and 2 are well known. In the example shown in FIG. 1, a propulsion water duct 3 extending from a water vessel bottom to a stern thereof is interposed in bent form over the length between an inlet 1 and an outlet 2. The linear space of this duct 3 contains an impeller 26 and a rotative drive shaft 27. The rotative drive shaft 27 is extended through the wall of the duct 3 and coupled with a main engine 15 arranged in the vessel on the extension of the axial line of the shaft 27. In the case of FIG. 2, on the other hand, the propulsion water inlet 1 is suspended below the vessel bottom in the neighborhood of a hydrofoil 28 beneath the water and is open in the forward direction in order to introduce water when the vessel is cruising with the hull 4 levitated above the water surface by means of the hydrofoil 28 at high vessel speed. As described above, the conventional water jet propulsion apparatuses are such that the power of the main engine 15 is transmitted to the impeller 26 through the rotative drive shaft 27, and water is introduced from the duct inlet 1 by pumping due to the rotation of the impeller 26. The water thus pumped is discharged by way of the outlet 2, thereby to propel the vessel by reaction.

The water jet propulsion apparatus constructed as described above has the following problems.

A first problem relates to propulsion efficiency and high-speed performance and is that the bent form of the duct 3 necessarily changes the direction of water flow, thereby proportionally reducing propulsion efficiency. Especially when the vessel is cruising at high speed, a turbulent flow occurs in the bent portion of the duct, thereby increasing the very resistance of the duct 3. In the case of the hydrofoil vessel shown in FIG. 2, the hull 4 of which is floated above the water surface while cruising at high speed, the pump suction height from the water surface to the water jet propulsion apparatus increases. When this vessel is accelerated to levitate the hull 4, the dynamic pressure of the duct inlet 1 is not sufficient until a high cruising speed is reached. This easily causes cavitation by the turbulent flow in the duct 3, thereby reducing the pump efficiency. Also, in order to secure a large thrust for high speed cruising, it is necessary to inject a great amount of water at high rate per unit time for generating a large reaction of the jet. High speed rotation of the impeller 26 for this purpose may generate a cavitation which reduces the pump efficiency. Further, the impeller 26 may be damaged, thereby imposing a limitation on injection speed.

In view of this, such conventional water jet propulsion apparatus uses a pump with a margin of discharge having a large sectional area of the duct 3. The main engine 15 and the propulsion apparatus thus become bulky, and the thrust per unit weight is reduced. It is therefore difficult to increase the propulsion efficiency, thereby imposing a limitation on improvement of high speed performance. Further, the great amount of water injected from the outlet 2 of the propulsion apparatus toward the backward water surface brings with it a great kinetic energy for a reduced propulsion efficiency, resulting in a great energy loss.

A second problem, which relates to the form of the hull, is that since the driving force of the main engine 15 is transmitted to the impeller 26 by the rotative drive shaft 27, the linear arrangement of these components, together with a complicated arrangement of the duct 3, reduces the propulsion efficiency as described above. This also imposes a limitation on relative positions of the duct inlet 1, the outlet 2 and the main engine 15. Therefore, it is difficult to meet requirements of free form of the hull.

A third problem relating to course stability is that the water jet, when injected under water, is rapidly attenuated in flow rate as compared with injection in the air, and the thrust is reduced accordingly. In the conventional water jet propulsion apparatus, the jet is injected on the water surface or at substantially the same height as the water surface, as shown in FIGS. 1 and 2. As a result, the form of the hull shown in FIG. 1 is accompanied by an inferior course stability. Especially when the vessel is cruising at high speed, the hull slides at a high position on the water surface and the water jet is injected with a reduced contact area between the hull 4 and the water, resulting in further reduced course stability.

A fourth problem, which relates to maintenance, is that the bent form of the duct 3, and especially the large total length of the duct 3 in the cases of FIGS. 1 and 2, with movable parts such as the impeller 26 and the rotative drive shaft 27 built into the pump assembly, makes maintenance troublesome. In the case where foreign matter intrudes while the vessel is cruising, the impeller 26 will be damaged. It is therefore necessary to mount a garbage net or the like on the inlet 1 of the duct 3. In high speed craft requiring a high speed pump, in particular, the construction is so complicated by a plurality of impellers and stator vanes that maintenance is quite burdensome.

SUMMARY OF THE INVENTION

The object of the invention is to solve the abovementioned problems and to provide a water vessel propulsion apparatus providing improved course stability of the hull, easy maintenance, improved propulsion efficiency and improved high speed performance for any form of hull.

In order to achieve the above object, there is provided according to the present invention a vessel propulsion apparatus including a hull and having a rectilinear passage with an inlet and an outlet. An injection port opens into the passage of the duct and is directed toward the outlet. Air and water are ejected from the injection port into the passage.

According to one aspect of the invention, a second duct of larger diameter is arranged on the same axis as and around the outlet.

According to another aspect of the invention, the second duct of larger diameter around the outer periphery of the outlet can be mounted to be displaceable axially.

According to still another aspect of the invention, the duct has a thrust reverser that can be opened and closed as desired.

According to a further aspect of the invention, pressurized water is supplied to a pressurized water injection port open to the injection port and compressed air is supplied to a compressed air injection port around the pressurized water injection port.

According to a still further aspect of the invention, a guide vane is provided at the inner peripheral surface of the injection port for guiding the compressed air injected from the compressed air injection port radially outwardly of the axis of the duct.

According to still another aspect of the invention, a needle valve is provided for finely adjusting the flow rate of the pressurized water ejected from each pressurized water injection port.

According to the invention, the duct has no bent portion and the passage through the duct is rectilinear from inlet to outlet. The duct is short and is free of internal mechanical protrusions. A gaseous phase film is formed between the inner face of the duct and the water flow therethrough by an air jet, thereby to reduce the frictional resistance between the duct and water jet. As a result, resistance loss due to the duct is minimized for an improved propulsion efficiency. Also, by effectively using the dynamic pressure generated by cruising, the propulsion efficiency is remarkably improved at high vessel speeds, thereby leading to a great advantage for high speed cruising.

In a conventional water jet propulsion apparatus, cavitation generated by high speed rotation of an impeller, wear of a bearing and water sealing device due to high speed rotation of the impeller drive shaft, and endurance of a thrust bearing adversely affected by an increased axial thrust combine to impose mechanical limitations on high speed performance. According to the water jet propulsion apparatus of the invention, by contrast, such limitations on mechanical performance are avoided by driving the influent water of the duct by use of high pressure fluid. Further, the use of the air jet eliminates the occurrence of cavitation, and hence the limitation of the speed of injection of high pressure water under water is eliminated, thereby making it possible to produce the desired water jet injection speed. A water jet propulsion apparatus of the invention thus has superior high speed performance and high propulsion efficiency for high speed craft.

The duce has therein no mechanically movable parts such as an impeller and therefore is light in weight and achieves high thrust per unit weight. This makes the apparatus suitable for use with high speed craft. Also, the simple construction free of mechanical protrusions within the duct facilitates maintenance and prevents damage which otherwise might be caused by intruding foreign matter during cruising. Water jet injection under water, as compared with injection on the water surface according to the prior art, permits the utilization of water flow on the outer periphery of the duct by the second duct for further thrust, thus further improving propulsion efficiency. Also, the use of high pressure fluid for power transmission from the main engine makes possible a free layout of the engine room, and the propulsion apparatus easily is adapted to all hull forms. Even when the hull position rises to reduce the contact area between the hull and the water during high speed operation or cruising, the duct moves straight under the water in parallel to the direction of progress. As a result, course stability of the hull is improved. Especially pitching of the hull is effectively controlled. The under water injection of the water jet also reduces noise, and no annoying splashes are caused to neighboring vessels.

Further, according to the invention a desired vessel speed performance for a particular application may be obtained depending on the design of the section of the duct and the angle of the injection port. The propulsion apparatus according to the invention therefore us usable also for low speed vessels requiring a large thrust.

BRIEF DESCRIPTION OF THE DRAWINGS

Other and further objects, features, and advantages of the invention will be apparent from the following detailed description, taken with the accompanying drawings, wherein.

DETAILED DESCRIPTION OF THE INVENTION

Figure 1:
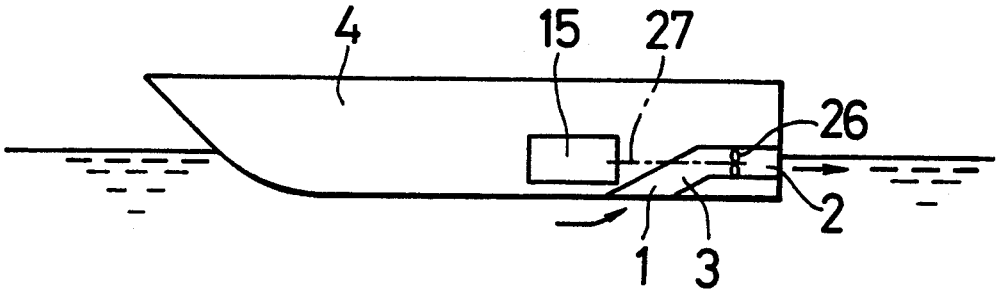
Fig. 1 Prior art
FIG. 1 is a schematic view of a conventional vessel propelled by a water jet.
Figure 2:
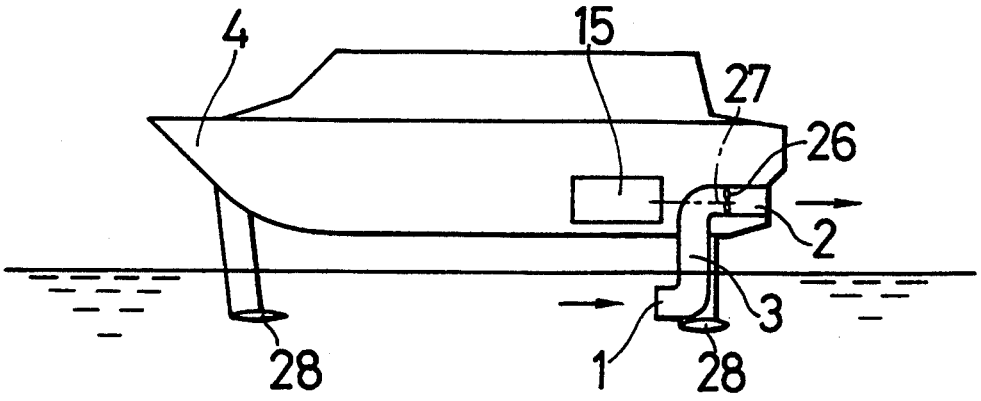
Fig. 2 Prior art
FIG. 2 is a schematic sectional view of a known hydrofoil vessel propelled by a water jet.
Figure 3:
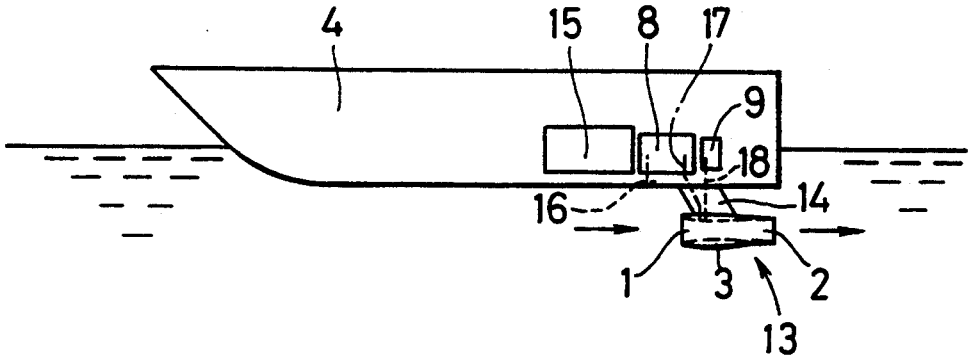
FIG. 3 is a schematic sectional view of a first embodiment of the invention.

Referring now to the drawings, preferred embodiments of the invention are described below.

FIGS. 3 to 6 show a first embodiment of the invention. Mounted on a hull 4 by a strut 14 is a propulsion apparatus 13. A high-pressure pump 8 in the full providing means driven by a main engine 15 for supplying pressurized water. Water introduced by way of an intake port 16 on the vessel bottom is sent by the high-pressure pump 8 as high pressure water through a pressurized water pipe 17 to a plurality of pressurized water injection ports 6 in a duct 3 of the propulsion apparatus 13. Air is compressed by a compressed air supply means 9 in the vessel and is supplied through a compressed air pipe 18 to the compressed air injection ports 7 that are paired with respective of the pressurized water injection ports 6. The high pressure pump 8 and the compressed air supply means 9 form injection means.

The intake port 16 is disposed, together with a trash net or the like for blocking the inflow of trash, at such a position in the vessel bottom or the strut 14 as to be maintained under water even when the vessel travels at high speeds. A water chamber is formed between the intake port 16 and the high pressure pump 8. Any air which might be introduced through the water intake port 16, e.g. at a time of oscillation of the hull 4 or when the vessel is at the bottom of a high wave, thereby is separated from the water. Further, small trash that might flow in with water are removed by a strainer. Thus, only water is drawn into the high pressure pump 8. The compressed air supply means 9 is provided by an air compressor driven by the main engine 15 or by an auxiliary power unit. An alternative arrangement is to use the exhaust gas of the main engine 15 or, if the main engine 15 is a gas turbine, the compressed air may be recovered directly at the outlet or in the middle stage of the compressor thereof.

Figure 5:
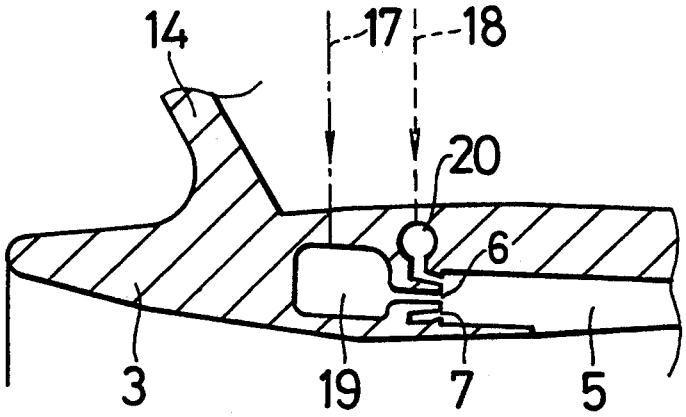
FIG. 5 is a partial sectional view of the propulsion apparatus.
Figure 6:
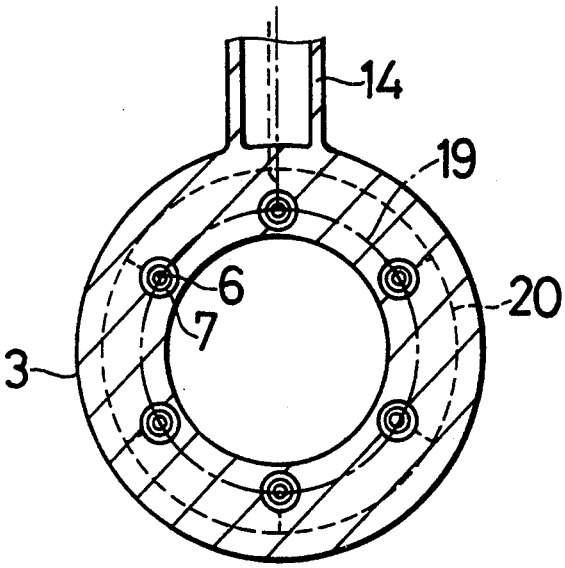
FIG. 6 is a sectional view taken along line 6—6 in FIG. 4.

FIG. 5 shows in detail the pressurized water injection ports 6 and the compressed air injection ports 7. The water supplied under pressure through pressurized water pipe 17 is supplied to each pressurized water injection port 6 through an annular pressurized water chamber 19 arranged on the inner periphery of the duct section. The compressed air supplied through compressed air pipe 18, on the other hand, is supplied further to each compressed air injection port 7 by way of an annular compressed air communication pipe 20.

Upon high speed injection under water, the water jet is rapidly attenuated compared with a water jet injected in the air. It is well known, however, that a water jet surrounded by air has the same effect as if the water is injected into the air. According to the embodiment of FIGS. 5 and 6, an annular compressed air injection port 7 is provided concentrically the pressuring water injection ports 6 on the outer periphery thereof, so that the high pressure water jet is injected in a form contained within an air jet. The pressurized water injection ports 6 and the compressed air injection ports 7 are installed within injection ports 5, which in turn are directed toward an outlet 2 of duct 3. As a result, the high speed jet comprised of high pressure water and compressed air injected from the injection port 5 rushes toward the outlet 2 of duct 3 without being rapidly attenuated. Such high speed jet acts on water within the longitudinal passage of the duct 3, and a water flow thereby is created through the entire interior length of such passage. The water jet thus injected from the outlet 2 produces a thrust.

During this process, the air jet forms a gaseous phase film on the inner surfaces of the passage through the duct 3 and of the injection port 5. Frictional resistance between the high speed jet and the inner surfaces of the injection port 5 and the passage through the duct 3 thereby is reduced. Further, the gaseous phase film contains the water jet injected from the outlet 2, thereby preventing a rapid reduction in the injection speed of the water jet and an improved propulsion efficiency. While the vessel is cruising, a dynamic pressure of water with a speed relative to the vessel speed is generated at the duct inlet 1. Thereby, the water at the front of the duct 3 is pressed into the passage through the duct 3 from the inlet 1 under ram pressure.

Figure 4:
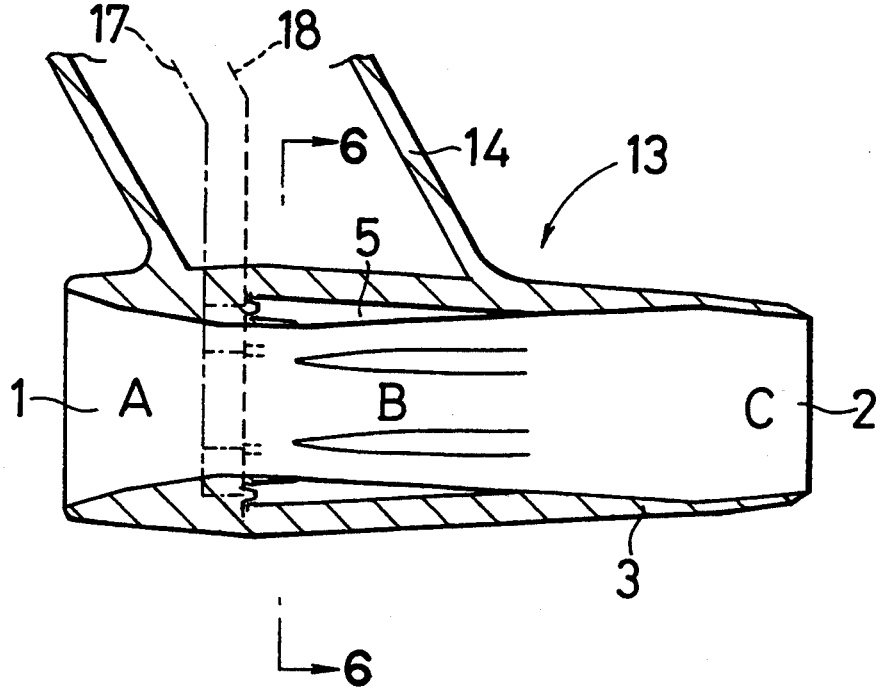
FIG. 4 is an enlarged sectional view of a propulsion apparatus shown in FIG. 3.

The operation of the duct 3 will be explained with reference to FIG. 4. As the shape (section) of the passage through the duct 3 changes longitudinally, the influent water is sped up at a duct portion A, and is mixed with the high speed jet at a portion B (defuser) to exchange momentum. Thus, the energy of velocity is converted into that of pressure, while pressure is increased to form a mixed water flow. The water jet is further sped up at a portion C (nozzle) and injected from the outlet 2. The resulting reaction produces a water jet thrust.

In the vessel propulsion apparatus according to this embodiment, the duct 3 between the inlet 1 and the outlet 2 is linear and short, and is free of internal protrusions. Frictional resistance between the inner surface of the duct 3 and the water flow is reduced by the air jet. Further, the dynamic pressure generated by cruising of the vessel is effectively used as a thrust, resulting in high propulsion efficiency. In conventional water jet propulsion apparatuses, cavitation generated by high speed rotation of the impeller, wear of a water sealing device and a bearing due to high speed rotation of a rotative drive shaft of the impeller and endurance of a thrust bearing adversely affected by an increased axial thrust all combine to impose mechanical limitations of high speed performance. According to the water jet propulsion apparatus of the invention, by contrast the influent water of the duct is driven by a high pressure fluid, and therefore the above mentioned limitation on mechanical performance is eliminated. Further, the air jet removes cavitation, whereby the limitation on the injection speed of the high pressure water under water is also eliminated, thereby making it possible to obtain the desired water jet injection speed. As a result, a water jet propulsion apparatus with superior high speed performance and high propulsion efficiency is provided for a high speed craft.

The duct 3 is free of internal mechanical movable parts such as an impeller, and therefore is light in weight and achieves high thrust per unit weight. The apparatus of the invention is thus suitably used for high speed craft. Further, the propulsion apparatus according to the invention is simple in construction, and has no mechanical protrusions in the passage through the duct 3, with the results that the apparatus is not damaged by intruding foreign material during use and maintenance operations easily are conducted.

Also, a desired thrust characteristic is obtained by appropriate design of the section of the duct 3. In the case of a high speed craft, for example, the high flow rate of influent water reduces the flow rate ratio between the influent water and the high speed jet. Therefore, the change in sectional area of the duce 3 is reduced to secure a smooth, linear shape. For applications to vessels requiring a large thrust with low speed, on the other hand, the low flow rate of influent water with a high flow rate ratio makes it necessary to increase the flow rate of the influent water by increasing the change in sectional area of the portion A of the duct 3 to reduce the flow rate ratio. Also, the portion B (defuser) of the duct 3 is lengthened, and the bore of the outlet 2 is increased to secure a high pressure characteristic of the jet from the outlet 2 at a low speed. Further, in order to improve the propulsion efficiency at a low vessel speed, the injection port 5 is formed in the direction toward the duct outlet 2 at an angle to a plane containing the axial center line of the duct 3, whereby the high speed jet injected from the injection port 5 swirls in the duct 3, with the result that a vortex occurs in the duct 3. Thus, the flow rate along the axial center of the duce is reduced, while at the same time the vortex generated at the inlet 1 absorbs the influent water. Consequently, a large thrust characteristic is obtained at low speed operation involving a low dynamic pressure. A water jet propulsion apparatus suitable for vessels requiring a large thrust at low speed thereby is provided.

Figure 7:
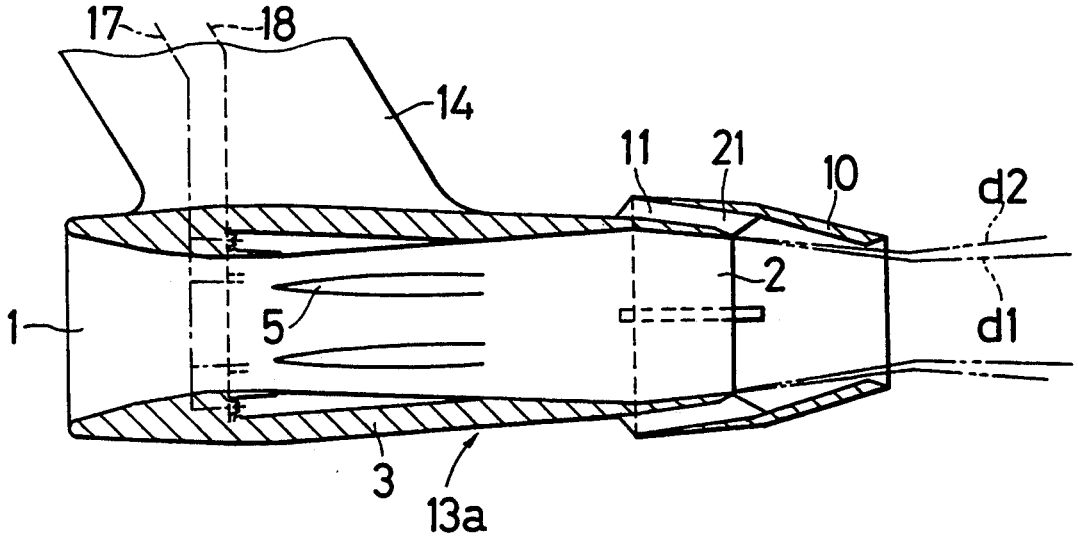
FIG. 7 is a sectional view of a propulsion apparatus according to a second embodiment of the invention.

A second embodiment of the invention is shown in FIG. 7. In the propulsion apparatus 13*a* according to this embodiment, a second duct 10 having a section larger than the outlet 2 of the duct 3 is overlaid outwardly on the duct 3, concentrically therewith, by means of a plurality of support plates 21 that are arranged parallel to the axis of duct 3 at positions between the outer peripheral surface of the overlaid portion of duct 3 and the inner peripheral surface of the second duct 10. A flow path 11 along the duct axis partitioned by the support plates 21 is formed between the outer peripheral surface of the duct 3 and the inner peripheral surface of the second duct 10. The second duct 10 is extended rearwardly from the overlaid portion by a given length rearwardly of the duct outlet and progressively reduces in sectional area in such a manner as to converge toward the duct axis. The jet injected from the duct outlet 2 causes a wake backward of the outlet 2 by shearing and inducing the surrounding water and is diffused into a flow with a large amount of kinetic energy. According to the first embodiment of the invention, the kinetic energy of rearwardly of the duct outlet 2 is not used at all. In the present embodiment however, the water flow along the outer periphery of the duct 3 caused by cruising is introduced into the flow path 11 of the second duct 10. This flow is rectified in the second duct 10 in such a manner as to form a wake by merging with the jet from the duct outlet 2 at an appropriate angle, so that part of the kinetic energy is recovered by the second duct 10 behind the outlet 2, thereby improving propulsion efficiency.

A water jet propulsion apparatus as a jet designed or set to assume an optimum condition at high vessel speeds. Normally therefore, the propulsion efficiency is lower when the vessel is cruising at a low speed than when it is cruising at a high speed. The reason is that the propulsion efficiency, which changes with the speed ratio (=jet flow rate/vessel speed), is generally set to assume a maximum value when cruising at a high speed for a high speed craft, and therefore is reduced with a higher speed ratio at low vessel speeds. According to the second embodiment, the jet ejected from the outlet 2, which is merged with the high speed water flow from the path 11 of the second duct 10 to converge toward the duct axis, is injected in converged form as shown by dashed lines d1 in FIG. 7 when the vessel is cruising at a high speed. When the vessel speed is low, by contrast the water flowing in by way of the flow path 11 also merges with the jet at low speed, and therefore the jet expands and assumes an enlarged section as shown by dashed line d2 in FIG. 7, resulting in a lower jet flow rate. As a result, compared with the conventional water jet propulsion apparatuses in which the speed ratio increases with a decrease in vessel speed, the water jet propulsion apparatus according to this embodiment has improved low speed propulsion efficiency in view of the fact that the speed ratio does not increase as the flow rate of the jet decreases due to the operation of the second duct 10 at low vessel speeds, thereby improving the propulsion efficiency when the vessel is cruising at low speeds.

Figure 8:
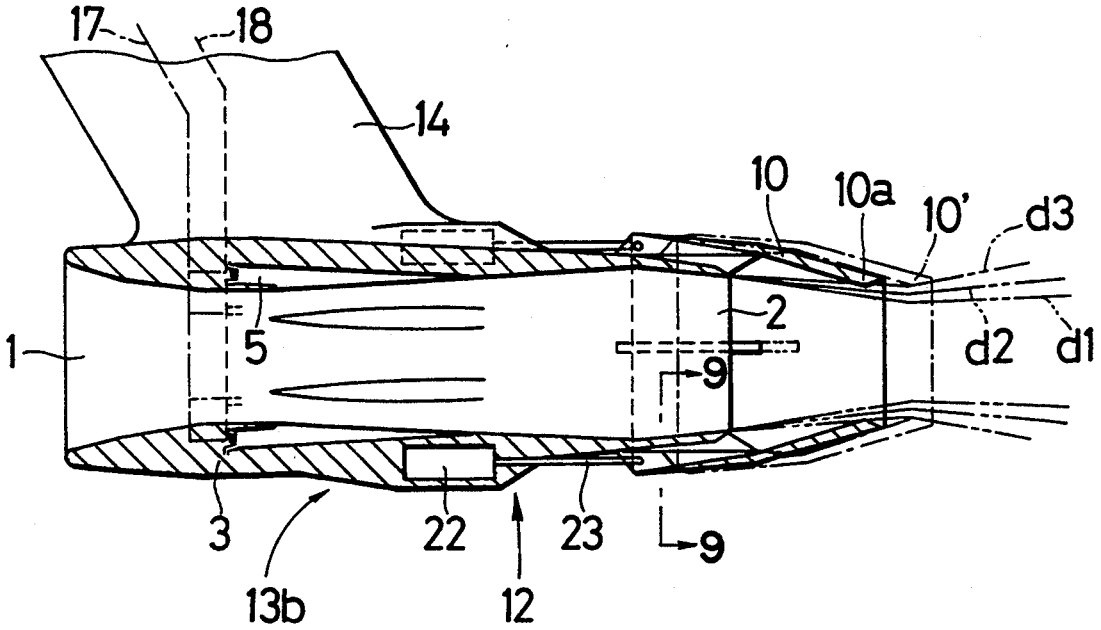
FIG. 8 is a sectional view of a propulsion apparatus according to a third embodiment of the invention.
Figure 9:
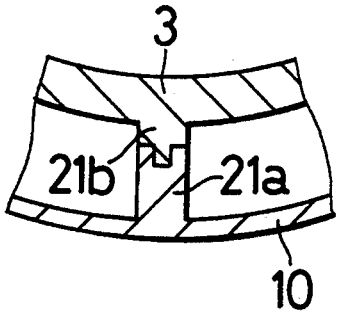
FIG. 9 is a partial enlarged sectional view taken along line 9—9 in FIG. 8.

A third embodiment of the invention is shown in FIGS. 8 to 9. The propulsion apparatus 13*b* according to this embodiment includes a second duct 10, as in the second embodiment, mounting slidably on the same axis as the duct 3. FIG. 9 shows the manner in which the second duct 10 is mounted. A recess of a support plate 21*a* of the second duct 10 is fitted slidably on a protruding portion of a support plate 21*b*. The second duct 10, as shown by dashed lines 10' in FIG. 8, is adapted to slide rearwardly coaxially of the duct 3. A drive means 12 for sliding the second duct 10 is either of the oil hydraulic type using an oil hydraulic drive unit 22 on the duct 3 and a rod 23, or is electrically driven by a drive motor and a gear mechanism. A control unit (not shown) in the hull is connected with the oil hydraulic drive unit 22 to slide the second duct 10 as desired. When the second duct 10 slides rearwardly, the rearmost end 10*a* of the second duct 10, that has thus far converged the jet toward the duct axis, also moves rearwardly. Therefore, the jet is changed as shown by dashed lines d2, d3 in FIG. 8 in such a way as to increase the sectional area thereof, thereby reducing the flow rate thereof.

In the second embodiment, the propulsion efficiency dependent on the vessel speed is adjusted by changing the sectional area of the jet by the use of the water flow along the outer periphery of the duct 3 relative to the vessel speed. However, according to the third embodiment, the second duct 10 is moved rearwardly to further increase the sectional area of the jet. This not only improves the propulsion efficiency over a wide range of vessel speeds as compared with the second embodiment, but also attains a propulsion efficiency suitable for particular cruising conditions by adjustment of the jet as desired, independently of the vessel speed. When a hydrofoil vessel accelerates to levitate the hull 4 above the water surface, for example, the water resistance to the hull 4 remains large until the hull 4 is sufficiently levitated, and maximum thrust is required for acceleration until the vessel speed reaches a level sufficient for such levitation. The conventional water jet propulsion apparatuses, which are set to reach the maximum propulsion efficiency at high cruising speeds, are very disadvantageous and require a propulsion apparatus having a considerable margin of thrust. According to the propulsion apparatus 13*b* of the third embodiment, such a disadvantage is eliminated by sliding the second duct 10 rearwardly during levitation of the hull 4 for a short time of acceleration at a large thrust obtainable even at low vessel speeds. As a consequence, the need for a bulky propulsion apparatus that otherwise would be required at low speeds but that is not required for high speed cruising is eliminated. Therefore, the vessel weight is reduced, and this is even further advantageous for high speed cruising.

The sliding motion of the second duct 10 is automatically effected in accordance with cruising conditions. For this purpose, output signals from a vessel speed detector, a main engine output control and dynamic pressure sensors at the duct inlet 1 and the outlet 2 are applied to an arithmetic unit having various cruising conditions programmed therein. The maneuvering system of the vessel is preferably such that the second duct control unit is subjected to programmed control by the arithmetic unit in interlocked relation with the output control unit of the main engine, so that the amount of sliding movement of the second duct 10 is optimized automatically.

Figure 10:
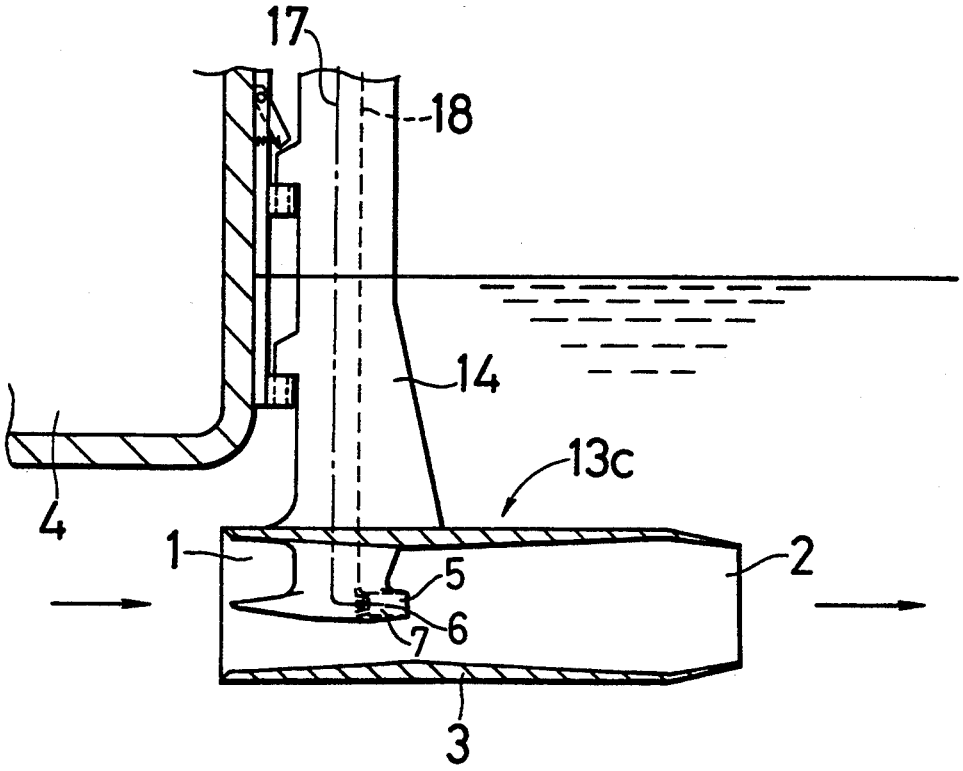
FIG. 10 is a sectional view showing a propulsion apparatus according to a fourth embodiment of the invention and also showing mounting thereof.

A fourth embodiment of the invention is shown in FIG. 10. A propulsion apparatus 13*c* according to this embodiment, which is reduced in size for application to small vessels, comprises a single injection port 5 on the axis of the duct 3. A strut 14 is partly extended into the duct 3 to the axis thereof, and the injection port 5 is arranged on such extension and is directed toward the outlet 2 concentrically with the duct. As a result, the sectional area of the duct 3 can be decreased, thereby providing a compact propulsion apparatus that is light in weight and simple in construction. Also, small apertures may be formed at desired intervals at the inner periphery of the duct 3 at appropriate positions thereof. Compressed air is supplied into such apertures to form a gaseous phase film between the inner surface of the duct 3 and the water flow therein, thereby to reduce the frictional resistance of the water flow. FIG. 10 shows the manner in which propulsion apparatus 13*c* is mounted on the hull 4 as an outboard motor. The propulsion apparatus 13*c* is mounted on a stern of the hull and is pivotally movable around a perpendicular axis at the forward end of the strut 14. By pivoting the propulsion apparatus 13*c* around such axis, the direction of propulsion of the hull 4 can be changed. This compact and lightweight propulsion apparatus can be accommodated as an independent until in the hull. The pressurized water pipe 17 and the compressed air pipe 18 are connected to respective high pressure hoses by couplers. Since such hoses easily are removable, the propulsion apparatus 13*c* also can readily be dismounted. This apparatus is simple in construction and easily is maintained.

Figure 11:
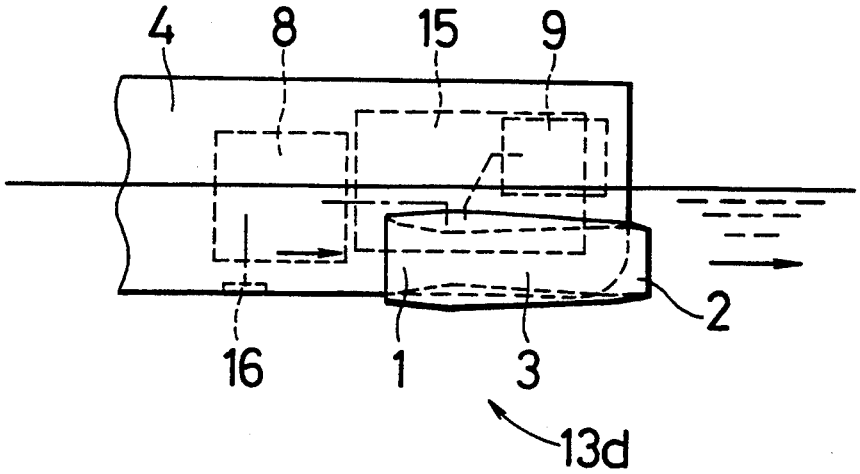
FIG. 11 is a side view of a propulsion apparatus according to a fifth embodiment of the invention and also showing mounting thereof.
Figure 12:
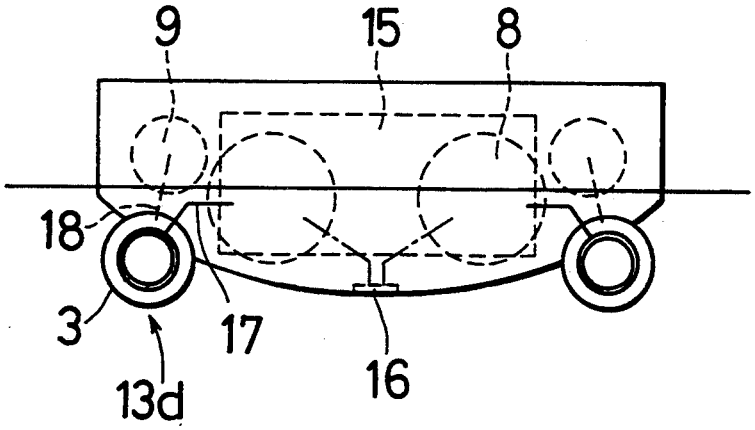
FIG. 12 is a view as viewed from the rear in FIG. 11.

A fifth embodiment of the invention is shown in FIGS. 11 and 12. This embodiment is used for a vessel capable of cruising in shallow areas as is a conventional water jet propulsion apparatus. Therefore, no strut is used with the apparatus which is mounted directly on the hull 4. The propulsion apparatus 13*d* is shown mounted at the stern adjacent a main engine 15, a high pressure pump 8, an air compressor 9, etc. The propulsion apparatus 13*d* is arranged with the bottom thereof substantially level with the vessel bottom. The vessel carrying the apparatus thus is capable of cruising in shallow areas. In the conventional water jet propulsion apparatus, the propulsion apparatus and the main engine 15 are linearly arranged in series in the longitudinal direction of the hull 4 as shown in FIG. 1. According to the water jet propulsion apparatus of the invention, which uses a high pressure fluid for power transmission from the main engine 15, however, the propulsion apparatus and the main engine can be arranged in parallel, illustrated, or freely can be arranged otherwise according to the vessel style. The engine room thus can be reduced in size, thereby permitting effective utilization of inboard space. In order to reduce the water flow resistance at the mounted position of the duct 3 and the hull 4, the duct 3 and the hull 4 may be formed integrally to attain a streamlined vessel shape.

Figure 13:
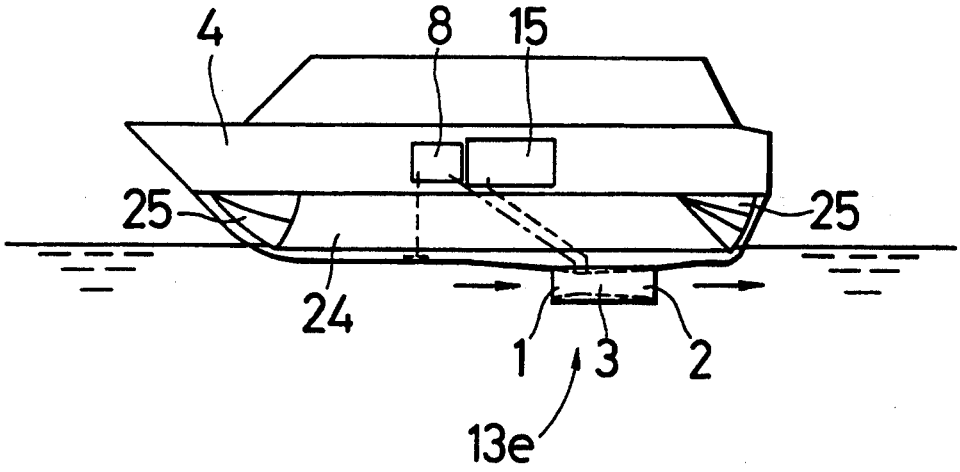
FIG. 13 is a schematic sectional view of a propulsion apparatus according to a six embodiment of the invention and also showing mounting thereof.
Figure 14:
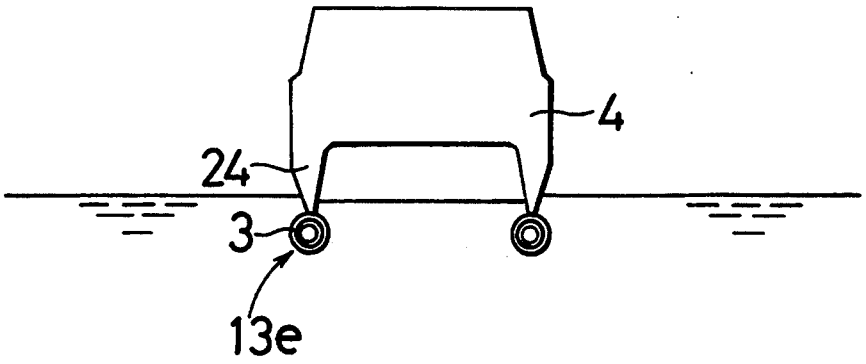
FIG. 14 is an end view of the hull of FIG. 13.

A sixth embodiment of the invention is shown in FIGS. 13 and 14. This embodiment represents an example of the water jet propulsion apparatus 13*e* according to the invention employed on a surface effect ship (SES). The SES, as shown in FIG. 13, is so constructed that air is sent into the lower part of the vessel bottom surrounded by a side wall 24 and a front and rear seal 25 to permit high speeds than other hull forms. FIG. 14 is a schematic cross-sectional view of an SES cruising at high speed. The hull 4 is levitated under air pressure, and the lower end of the hull side wall 24 is slightly immersed in the water. The water resistance therefore is small and high speed cruising is realized. However, the reduced contact area between the hull 4 and water reduces the course stability of the vessel. A water jet propulsion apparatus 13*e* of the invention is arranged at the lower end of each hull side wall 24 as shown, and improves course stability since the duct 3 progresses straight ahead horizontally under water in the direction of vessel cruising. In particular, pitching of the hull 4 is controlled effectively. The use of a conventional water jet propulsion apparatus makes it difficult to improve high speed performance, as propulsion efficiency is reduced in a conventional SES which, for its high cruising speed, has a large resistance due to the length of the duct and the bent portion thereof. The water jet propulsion apparatus according to the invention, on the other hand, has a short, linear duct 3 that is free of internal protrusions from the inlet to the outlet. A gaseous phase film is formed between the inner surface of the duct 3 and the water flow by an air jet flow to reduce frictional resistance between the duct 3 and the water flow. Pressure loss due to the duct 3 is thus minimized. At the same time, the dynamic pressure generated by cruising is used effectively. As a result, the propulsion efficiency is high at high vessel speeds and high speed performance is improved. In the case of ultra-high speed craft, air apertures of air slits may be formed at appropriate intervals on the outer periphery of the duct 3 and air may be supplied therethrough to form a gaseous phase film also on the outside of the duct 3. The frictional resistance of water thus can be reduced further.

Figure 15:
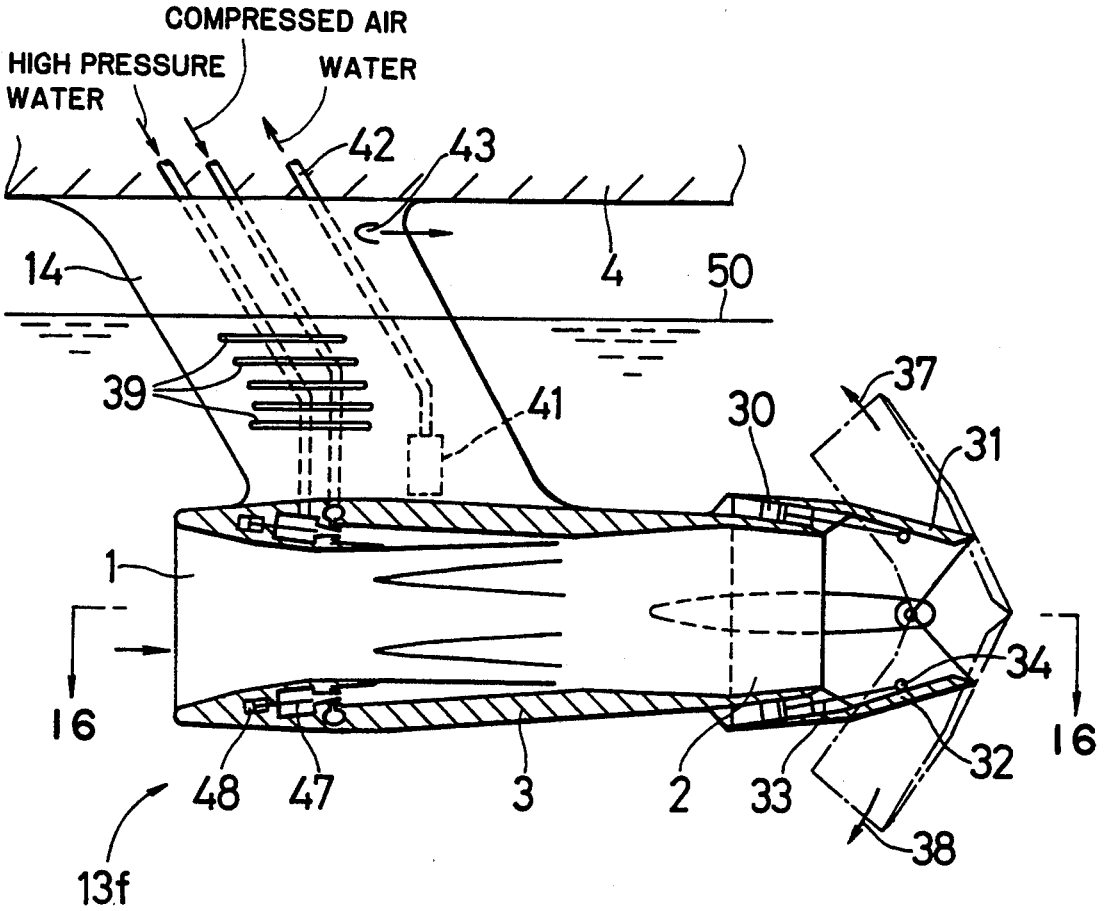
FIG. 15 is a sectional view of a propulsion apparatus according to a seventh embodiment of the invention.
Figure 16:
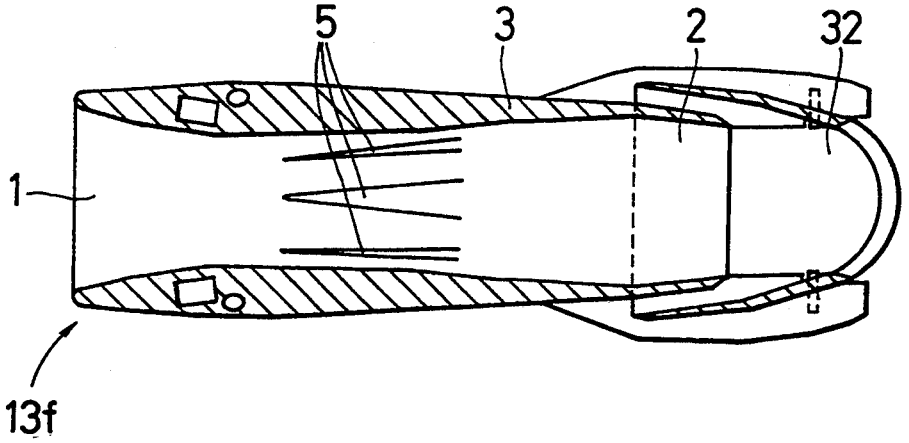
FIG. 16 is a horizontal sectional view taken along line 16—16 in FIG. 15.
Figure 17:
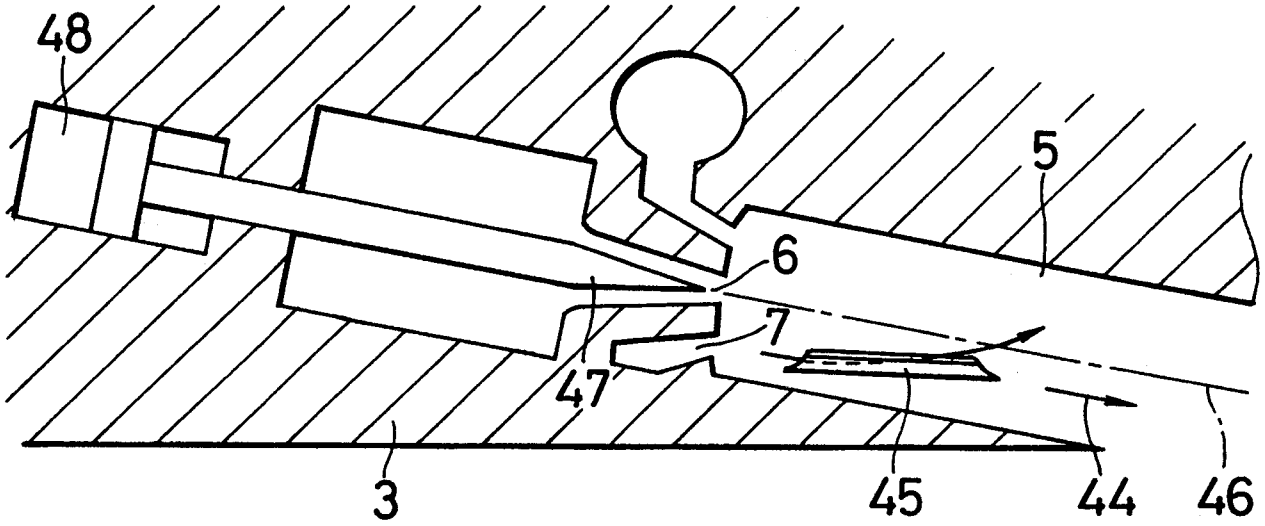
FIG. 17 is a partial enlarged sectional view of the propulsion apparatus of FIGS. 15 and 16.

A propulsion apparatus 13*f* according to a seventh embodiment of the invention is shown in FIGS. 15–17, FIG. 16 being a horizontal sectional view taken along line 16—16 in FIG. 15, and FIG. 17 being an enlarged sectional view of a part of the propulsion apparatus 13*f*. The propulsion apparatus 13*f* according to this embodiment includes two thrust reversers 31, 32 adapted to be opened and closed by double-acting fluid pressure cylinders 30. The thrust reversers 31, 32 have a substantially semi-arcuate section and are connected with piston rods 33 of the respective double-acting fluid pressure cylinders 30 by pins 34. The thrust reversers 31, 32 are capable of braking or driving the hull rearwardly by redirecting the jet forwardly as indicated by arrows 37, 38 when the thrust reversers are opened as shown by the dashed lines in FIG. 15. The trim of the hull 4 is adjustable by changing the water flow surrounding the duct 3 dependent on the degree of partial opening of each of the thrust reversers 31, 32.

The strut 14 is formed with a plurality of intake ports 39 to maintain the hull 4 below the draft line 50 of a vessel cruising in a levitated position. A strainer 41 is disposed below the first intake port 39. Water introduced by way of the intake ports 39 is supplied to strainer 41 to remove small trash not removed at the intake ports 39. Such water than is led through a conduit 42 to a high pressure pump (not shown) in the hull 4. Water introduced by way of the intake ports 39 is led to a water chamber formed in the strut 14, and then air and superfluous water in the water chamber are discharged from an exhaust port 43.

A guide vane 45 is inclined progressively outwardly of the downstream direction of flow 44 in injection port 5 is located adjacent the inner surface of each injection port 5, as shown in FIG. 17. Guide vane 45 is formed symmetrically with respect to a plane containing the axis 46 of the injection port 5. The air jet ejected from compressed air injection ports 7 is guided by the guide vane 45 outwardly within the injection port 5. When the air is ejected from port 5 toward the outlet 2 of the duct 3 the jet water flow through duct 3 is surrounded by a layer of air, thereby to minimize the contact area between the jet water flow and the inner surface of the duct 3. The frictional resistance exerted on the jet water flow is thus reduced to prevent attenuation of kinetic energy of the jet stream.

The degree of opening of each pressurized water injection port 6 is adjustable by a respective needle valve 47 which is displaceably movable in the axial direction of port 6 by a double-acting fluid pressure cylinder 48. The needle valve 47, which is used for adjusting the jet stream at low vessel speeds, is maintained at an extreme left position relative in FIG. 17, i.e. a fully retracted position, to fully open the pressurized water injection port 6 when the vessel is cruising at high speed. The propulsion apparatus 13*f* described above may be used in place of any of the propulsion apparatuses 13*a* to 13*e* according to the embodiments described above.

The water jet propulsion apparatus according to the invention, in which the influent water flow in a duct 3 is driven by a high pressure fluid, has no mechanically movable parts such as an impeller in the duct 3, and therefore no limitations are imposed on mechanical performance. Further, in view of the fact that the occurrence of cavitation is avoided by the air jet, the apparatus is free of a limitation which otherwise might be imposed on the injection speed of high pressure water under water. It is thus possible to obtain a desired high water jet injection rate. The apparatus according to the invention is preferably applicable for water jet propulsion of an SES or the like and achieves superior high speed performance and propulsion efficiency.

The invention may be embodied in other specific forms without departing from the spirit or essential characteristics of the invention. The above embodiments therefore are to be considered in all respects as illustrative and not restrictive, the scope of the invention being indicated by the appended claims rather than by the foregoing description, and all changes which come within the meaning and the range of equivalency of the claims are therefore intended to be embraced therein.

What is claimed is:

1. In a water vessel hull having a propulsion apparatus for propelling said hull through the water, the improvement wherein said propulsion apparatus comprises:

a duct connected to said hull and depending therefrom at a position to be beneath the water surface, said duct having extending entirely therethrough a rectilinear passage having an inlet and an outlet both to be open to the water;

at least one injection port extending into said passage at a position between said inlet and outlet thereof, said at least one injection port being directed toward said outlet;

a pressurized water port opening into said injection port in a direction toward said outlet;

a compressed air port surrounding said pressurized water port and opening into said injection port in a direction toward said outlet; and said pressurized water port and said compressed air port being connected respectively to pressurized water and compressed air sources in said hull, thereby to inject through said injection port into said passage a water jet and a surrounding air jet directed toward said outlet.

2. The improvement claimed in claim 1, wherein said compressed air source comprises an air compressor located in said hull.

3. The improvement claimed in claim 1, wherein said pressurized water source comprises a high pressure pump located in said hull and drawing water therethrough.

4. The improvement claimed in claim 1, comprising a plurality of said injection ports located at circumferentially spaced positions within said duct and opening into the periphery of said passage.

5. The improvement claimed in claim 4, comprising a plurality of said pressurized water ports located at circumferentially spaced positions within said duct and opening into respective said injection ports.

6. The improvement claimed in claim 5, further comprising an annular pressurized water chamber formed in said duct and opening into said plurality of pressurized water ports.

7. The improvement claimed in claim 4, comprising a plurality of said compressed air ports located at circumferentially spaced positions within said duct and opening into respective said injection ports.

8. The improvement claimed in claim 7, further comprising an annular compressed air chamber formed in said duct and opening into said plurality of compressed air ports.

9. The improvement claimed in claim 1, further comprising a second duct having a larger diameter than said duct and positioned coaxially outwardly of said duct an extending rearwardly beyond a rear end thereof.

10. The improvement claimed in claim 9, wherein said second duct is displaceable relative to said duct in directions axially thereof.

11. The improvement claimed in claim 1, further comprising at least one thrust reverser mounted on said duct adjacent a rear end thereof.

12. The improvement claimed in claim 1, comprising a single said injection port formed in a support extending into said passage from said duct, said single injection port being located on a longitudinal center axis of said passage.

13. The improvement claimed in claim 1, further comprising a guide vane positioned in said injection port at a position confronting said compressed air port and extending in a direction inclined outwardly from the direction of an air jet ejected from said compressed air port.

14. The improvement claimed in claim 1, further comprising a needle valve positioned in said duct for movement toward and away from said pressurized water port, thereby to regulate the degree of opening thereof.

15. A propulsion apparatus for propelling a water vessel hull through water, said propulsion apparatus comprising:

a duct to be connected to the hull to depend therefrom at a position to be beneath the water surface, said duct having extending entirely therethrough a rectilinear passage having an inlet and an outlet both to be open to the water;

at least one injection port extending into said passage at a position between said inlet and outlet thereof, said at least one injection port being directed toward said outlet;

a pressurized water port opening into said injection port in a direction toward said outlet;

a compressed air port surrounding said pressurized water port and opening into said injection port in a direction toward said outlet; and said pressurized water port and said compressed air port being connected to respective connections through said duct to enable the respective supply thereto of pressurized water and compressed air, thereby to enable the injection through said injection port into said passage of a water jet and a surrounding air jet directed toward said outlet.

16. A propulsion apparatus as claimed in claim 15, comprising a plurality of said injection ports located at circumferentially spaced positions within said duct and opening into the periphery of said passage.

17. A propulsion apparatus as claimed in claim 16, comprising a plurality of said pressurized water ports located at circumferentially spaced positions within said duct and opening into respective said injection ports.

18. A propulsion apparatus as claimed in claim 17, further comprising an annular pressurized water chamber formed in said duct and opening into said plurality of pressurized water ports.

19. A propulsion apparatus as claimed in claim 16, comprising a plurality of said compressed air ports located at circumferentially spaced positions within said duct and opening into respective said injection ports.

20. A propulsion apparatus as claimed in claim 19, further comprising an annular compressed air chamber formed in said duct and opening into said plurality of compressed air ports.

21. A propulsion apparatus as claimed in claim 15, further comprising a second duct having a larger diameter than said duct and positioned coaxially outwardly of said duct and extending rearwardly beyond a rear end thereof.

22. A propulsion apparatus as claimed in claim 21, wherein said second duct is displaceable relative to said duct in directions axially thereof.

23. A propulsion apparatus as claimed in claim 15, further comprising at least one thrust reverser mounted on said duct adjacent a rear end thereof.

24. A propulsion apparatus as claimed in claim 15, comprising a single said injection port formed in a support extending into said passage from said duct, said single injection port being located on a longitudinal center axis of said passage.

25. A propulsion apparatus as claimed in claim 15, further comprising a guide vane positioned in said injection port at a position confronting said compressed air port and extending in a direction inclined outwardly from the direction of an air jet ejected from said compressed air port.

26. A propulsion apparatus as claimed in claim 15, further comprising a needle valve positioned in said duct for movement toward and away from said pressurized water port, thereby to regulate the degree of opening thereof.

* * * * *